US008220846B2

(12) United States Patent
Liang et al.

(10) Patent No.: US 8,220,846 B2
(45) Date of Patent: Jul. 17, 2012

(54) LATCH FOR TILTABLE SASH WINDOWS

(75) Inventors: Luke Liang, South Plainfield, NJ (US); Tong Liang, Guangzhou (CN); David Chen, Guangzhou (CN)

(73) Assignee: Vision Industries Group, Inc.

( * ) Notice: Subject to any disclaimer, the term of this patent is extended or adjusted under 35 U.S.C. 154(b) by 997 days.

(21) Appl. No.: 12/228,887

(22) Filed: Aug. 15, 2008

(65) Prior Publication Data

US 2010/0037524 A1 Feb. 18, 2010

(51) Int. Cl.
*E05C 1/08* (2006.01)

(52) U.S. Cl. ..... 292/163; 292/DIG. 41; 49/161

(58) Field of Classification Search ..... 292/163, 292/DIG. 41
See application file for complete search history.

(56) References Cited

U.S. PATENT DOCUMENTS

| | | | | | |
|---|---|---|---|---|---|
| 913,409 | A | * | 2/1909 | Marbach | 292/2 |
| 2,917,336 | A | * | 12/1959 | Schlage | 292/2 |
| 4,066,284 | A | | 1/1978 | Ikemura | |
| 4,102,546 | A | | 7/1978 | Costello | |
| 4,137,671 | A | | 2/1979 | Miller | |
| 4,223,930 | A | | 9/1980 | Costello et al. | |
| 4,235,465 | A | | 11/1980 | Costello | |
| 4,301,622 | A | | 11/1981 | Dunsmoor | |
| 4,320,597 | A | | 3/1982 | Sterner, Jr. | |
| 4,356,667 | A | | 11/1982 | Malachowski | |
| 4,395,847 | A | | 8/1983 | Atchison | |
| 4,400,026 | A | | 8/1983 | Brown, Jr. | |
| 4,475,311 | A | | 10/1984 | Gibson | |
| 4,553,353 | A | | 11/1985 | Simpson | |
| 4,578,903 | A | | 4/1986 | Simpson | |
| 4,635,396 | A | | 1/1987 | Ranz et al. | |
| 4,683,736 | A | * | 8/1987 | Weinerman et al. | 70/208 |
| D295,019 | S | | 4/1988 | Bocson | |
| 4,779,908 | A | * | 10/1988 | Foshee et al. | 292/163 |
| 4,791,756 | A | | 12/1988 | Simpson | |
| 4,837,975 | A | | 6/1989 | Simpson | |
| 4,887,392 | A | | 12/1989 | Lense | |
| 4,888,915 | A | | 12/1989 | Goldenberg | |
| 4,901,475 | A | | 2/1990 | Simpson | |
| 4,924,930 | A | | 5/1990 | Drennan | |
| 4,953,372 | A | | 9/1990 | Lovell et al. | |
| 4,961,286 | A | | 10/1990 | Bezubic | |
| 4,974,887 | A | | 12/1990 | Pucci | |
| 4,976,066 | A | | 12/1990 | Plummer et al. | |
| 5,069,483 | A | | 12/1991 | Hirasawa | |
| 5,119,591 | A | | 6/1992 | Sterner, Jr. et al. | |
| 5,121,951 | A | | 6/1992 | Harbom et al. | |
| 5,139,291 | A | * | 8/1992 | Schultz | 292/42 |
| 5,165,737 | A | | 11/1992 | Riegelman | |

(Continued)

*Primary Examiner* — Gary Estremsky
(74) *Attorney, Agent, or Firm* — Thomas A. O'Rourke; Bodner & Rourke, LLP

(57) ABSTRACT

A latch is provided for use principally on a pivotal sash window of a double-hung sash window assembly. The latch comprises a latch-bolt slidably mounted within and biased relative to a housing, where the housing is mounted to the top rail of the sash window. The latch bolt is connected to a button for manual actuation of the latch bolt. The latch bolt, while maintaining the convenience and utility of a standard short throw latch, is contoured and designed to maintain engagement with the jam after the window has been deformed under high sustained wind loading typically experienced during extreme weather phenomena such as hurricanes and tornados. The engagement is assured in spite of twisting of the latch bolt within the corresponding opening in the jam.

19 Claims, 7 Drawing Sheets

U.S. PATENT DOCUMENTS

| | | | | |
|---|---|---|---|---|
| 5,167,131 | A | 12/1992 | Karkhanis | |
| 5,168,665 | A | 12/1992 | Goldenberg | |
| 5,274,955 | A | 1/1994 | Dallaire et al. | |
| 5,406,749 | A | 4/1995 | Goldenberg | |
| 5,592,781 | A | 1/1997 | Mauro | |
| 5,620,214 | A | 4/1997 | Kondratuk | |
| 5,669,639 | A | 9/1997 | Lawrence | |
| 5,715,631 | A | 2/1998 | Kailian et al. | |
| 5,901,501 | A | 5/1999 | Fountaine | |
| 5,918,916 | A * | 7/1999 | Kajuch | 292/163 |
| 5,927,014 | A | 7/1999 | Goldenberg | |
| 6,178,696 | B1 | 1/2001 | Liang | |
| 6,311,439 | B1 | 11/2001 | Arcati et al. | |
| 6,364,375 | B1 | 4/2002 | Szapucki et al. | |
| 6,506,112 | B1 | 1/2003 | Halbleib et al. | |
| 6,546,671 | B2 | 4/2003 | Mitchell et al. | |
| 6,565,133 | B1 | 5/2003 | Timothy | |
| 6,567,708 | B1 | 5/2003 | Bechtel et al. | |
| 6,572,158 | B2 | 6/2003 | Szapucki et al. | |
| 6,607,221 | B1 | 8/2003 | Elliott | |
| 6,679,001 | B1 | 1/2004 | Guelck | |
| 6,722,712 | B2 * | 4/2004 | Schultz | 292/175 |
| 6,829,511 | B2 | 12/2004 | Bechtel et al. | |
| 6,871,885 | B2 | 3/2005 | Goldenberg et al. | |
| 6,968,646 | B2 | 11/2005 | Goldenberg et al. | |
| 7,013,603 | B2 * | 3/2006 | Eenigenburg et al. | 49/185 |
| 7,085,609 | B2 | 8/2006 | Bechtel et al. | |
| 7,147,255 | B2 | 12/2006 | Goldenberg et al. | |
| 7,159,908 | B2 | 1/2007 | Liang | |
| 7,261,330 | B1 | 8/2007 | Hauber | |
| 7,296,381 | B1 | 11/2007 | McCabe et al. | |
| 7,322,619 | B2 | 1/2008 | Nolte et al. | |
| 7,363,747 | B2 | 4/2008 | Heck et al. | |
| 7,407,199 | B2 | 8/2008 | Richardson | |
| 7,494,164 | B1 | 2/2009 | Garries et al. | |
| 7,520,541 | B1 | 4/2009 | Lawrence | |
| 7,533,496 | B2 | 5/2009 | Tremble et al. | |
| 7,542,809 | B2 | 6/2009 | Bechtel et al. | |
| 7,571,568 | B2 | 8/2009 | Ito et al. | |
| 7,578,560 | B2 | 8/2009 | Spence, Jr. | |
| 7,579,802 | B2 | 8/2009 | Boisvert et al. | |
| 7,579,939 | B2 | 8/2009 | Schofield et al. | |
| 7,579,940 | B2 | 8/2009 | Schofield et al. | |
| 7,580,019 | B2 | 8/2009 | Hong et al. | |
| 7,580,100 | B2 | 8/2009 | Choi et al. | |
| 7,583,184 | B2 | 9/2009 | Schofield et al. | |
| 7,583,245 | B2 | 9/2009 | Kwon | |
| 7,584,577 | B2 | 9/2009 | Esmond et al. | |
| 7,584,976 | B2 | 9/2009 | Bayne et al. | |
| 7,584,998 | B2 | 9/2009 | Richter et al. | |
| 7,585,264 | B1 | 9/2009 | Wang et al. | |
| 7,585,277 | B2 | 9/2009 | Taylor et al. | |
| 7,585,747 | B1 | 9/2009 | Chen | |
| 7,586,600 | B2 | 9/2009 | Kao et al. | |
| 7,587,787 | B2 | 9/2009 | Pettit | |
| 7,587,886 | B1 | 9/2009 | Sugden | |
| 7,588,225 | B2 | 9/2009 | Wawerski | |
| 7,591,103 | B2 | 9/2009 | Tremble et al. | |
| 7,591,626 | B2 | 9/2009 | Curtis et al. | |
| 7,592,973 | B2 | 9/2009 | Choi | |
| 7,593,782 | B2 | 9/2009 | Jobs et al. | |
| 7,595,244 | B1 | 9/2009 | Bulucea et al. | |
| 7,596,902 | B2 | 10/2009 | Han et al. | |
| 7,597,290 | B2 | 10/2009 | Sugiura et al. | |
| 7,600,468 | B2 | 10/2009 | Zhang et al. | |
| 7,600,684 | B2 | 10/2009 | Tobin et al. | |
| 7,601,066 | B1 | 10/2009 | Masuyama et al. | |
| 7,601,298 | B2 | 10/2009 | Waldo et al. | |
| 7,602,230 | B2 | 10/2009 | Castaldo et al. | |
| 7,603,726 | B2 | 10/2009 | Sawalski et al. | |
| 7,605,590 | B2 | 10/2009 | Mulcahey | |
| 7,605,786 | B2 | 10/2009 | Yamazaki et al. | |
| 7,605,940 | B2 | 10/2009 | Silverbrook et al. | |
| 7,606,411 | B2 | 10/2009 | Venetsky et al. | |
| 7,606,552 | B2 | 10/2009 | Orr et al. | |
| 7,607,262 | B2 | 10/2009 | Pettit et al. | |
| 7,607,573 | B1 | 10/2009 | Gromley et al. | |
| 7,607,623 | B2 | 10/2009 | Wesolowski | |
| 7,608,847 | B2 | 10/2009 | Rees | |
| 7,610,637 | B2 | 11/2009 | Menkedick et al. | |
| 7,610,639 | B2 | 11/2009 | Roleder et al. | |
| 7,610,739 | B2 | 11/2009 | Godfrey | |
| 7,610,821 | B2 | 11/2009 | Klein | |
| 7,611,126 | B2 | 11/2009 | Vesa | |
| 7,611,204 | B2 | 11/2009 | Reed et al. | |
| 7,611,500 | B1 | 11/2009 | Lina et al. | |
| 7,612,307 | B2 | 11/2009 | Chou et al. | |
| 7,612,392 | B2 | 11/2009 | Jung et al. | |
| 7,612,856 | B2 | 11/2009 | Otose et al. | |
| 2002/0070565 | A1 | 6/2002 | Szapucki et al. | |
| 2002/0145291 | A1 | 10/2002 | Goldenberg et al. | |
| 2003/0024168 | A1 | 2/2003 | Mitchell et al. | |
| 2003/0145532 | A1 | 8/2003 | Kownacki et al. | |
| 2003/0191546 | A1 | 10/2003 | Bechtel et al. | |
| 2004/0000093 | A1 | 1/2004 | Guelck | |
| 2004/0036299 | A1 | 2/2004 | Goldenberg et al. | |
| 2004/0036300 | A1 | 2/2004 | Goldenberg et al. | |
| 2004/0226208 | A1 | 11/2004 | Kownacki et al. | |
| 2004/0262929 | A1 | 12/2004 | Trickel | |
| 2005/0028446 | A1 | 2/2005 | Fullick | |
| 2005/0063036 | A1 | 3/2005 | Bechtel et al. | |
| 2005/0144845 | A1 | 7/2005 | Heck, Jr. et al. | |
| 2006/0028028 | A1 * | 2/2006 | Schultz | 292/175 |
| 2006/0033345 | A1 | 2/2006 | Richardson | |
| 2006/0087130 | A1 | 4/2006 | Liang | |
| 2006/0207200 | A1 | 9/2006 | Arias | |
| 2006/0284424 | A1 | 12/2006 | Newbould et al. | |
| 2007/0029810 | A1 | 2/2007 | Nolte et al. | |
| 2007/0046031 | A1 | 3/2007 | Goldenberg et al. | |
| 2007/0067048 | A1 | 3/2007 | Bechtel et al. | |
| 2007/0157521 | A1 | 7/2007 | Ito et al. | |
| 2007/0158953 | A1 | 7/2007 | Liang | |
| 2007/0175252 | A1 | 8/2007 | Ramsauer | |
| 2007/0186478 | A1 | 8/2007 | Ozawa | |
| 2007/0194578 | A1 | 8/2007 | Boosey et al. | |
| 2007/0227075 | A1 | 10/2007 | Tremble et al. | |
| 2007/0271735 | A1 | 11/2007 | Ramsauer | |
| 2007/0289220 | A1 | 12/2007 | Vilhauer | |
| 2008/0053623 | A1 | 3/2008 | Goldenberg et al. | |
| 2008/0060401 | A1 | 3/2008 | Ramsauer | |
| 2008/0072532 | A1 | 3/2008 | Arias | |
| 2008/0129054 | A1 | 6/2008 | Tremble et al. | |
| 2008/0163551 | A1 | 7/2008 | Nolte et al. | |
| 2008/0168715 | A1 | 7/2008 | Titus | |
| 2008/0179896 | A1 | 7/2008 | Chung | |
| 2008/0295416 | A1 | 12/2008 | Kintz | |
| 2008/0296916 | A1 | 12/2008 | Kintz | |
| 2008/0302017 | A1 | 12/2008 | Phillips | |
| 2009/0066093 | A1 | 3/2009 | Garries et al. | |
| 2009/0079202 | A1 | 3/2009 | Wolf | |
| 2009/0113800 | A1 | 5/2009 | Garries et al. | |
| 2009/0173009 | A1 | 7/2009 | Garries et al. | |
| 2009/0199495 | A1 | 8/2009 | Garries et al. | |
| 2009/0199496 | A1 | 8/2009 | Garries et al. | |
| 2009/0204269 | A1 | 8/2009 | Bechtel et al. | |
| 2009/0217720 | A1 | 9/2009 | Herdman | |
| 2009/0218363 | A1 | 9/2009 | Terzini | |
| 2009/0223130 | A2 | 9/2009 | Ozawa | |
| 2009/0224585 | A1 | 9/2009 | Bokelmann et al. | |
| 2009/0236834 | A1 | 9/2009 | Turner et al. | |
| 2009/0239293 | A1 | 9/2009 | Sandell | |
| 2009/0240282 | A1 | 9/2009 | Mayer | |
| 2009/0241263 | A1 | 10/2009 | DeBraal et al. | |
| 2009/0241275 | A1 | 10/2009 | Johnson et al. | |
| 2009/0241284 | A1 | 10/2009 | Mayes et al. | |
| 2009/0241289 | A1 | 10/2009 | Choi et al. | |
| 2009/0241429 | A1 | 10/2009 | Polowinczak et al. | |
| 2009/0242002 | A1 | 10/2009 | Garman | |
| 2009/0242882 | A1 | 10/2009 | Leung et al. | |
| 2009/0243359 | A1 | 10/2009 | Yoshida et al. | |
| 2009/0249533 | A1 | 10/2009 | Sawalski et al. | |
| 2009/0249694 | A1 | 10/2009 | Nilsson | |
| 2009/0250574 | A1 | 10/2009 | Fullerton et al. | |
| 2009/0250575 | A1 | 10/2009 | Fullerton et al. | |
| 2009/0250576 | A1 | 10/2009 | Fullerton et al. | |
| 2009/0251255 | A1 | 10/2009 | Fullerton et al. | |
| 2009/0251256 | A1 | 10/2009 | Fullerton et al. | |

2009/0251394 A1 10/2009 Ahn et al.
2009/0251451 A1 10/2009 Cha et al.
2009/0255681 A1 10/2009 Spencer
2009/0257110 A1 10/2009 Ichikawa et al.
2009/0261565 A1 10/2009 David et al.
2009/0261626 A1 10/2009 Troutman et al.
2009/0263142 A1 10/2009 Shen et al.
2009/0263947 A1 10/2009 Hebert
2009/0265050 A1 10/2009 Burpee
2009/0265972 A1 10/2009 Chang
2009/0265991 A1 10/2009 Ito et al.
2009/0265996 A1 10/2009 Flory
2009/0265997 A1 10/2009 Flory
2009/0266354 A1 10/2009 Chen
2009/0266842 A1 10/2009 Snodgrass
2009/0267315 A1 10/2009 Suddaby et al.
2009/0267376 A1 10/2009 McDermott
2009/0267878 A1 10/2009 Song et al.
2009/0269933 A1 10/2009 Yamaguchi et al.
2009/0272035 A1 11/2009 Boisvert et al.
2009/0273214 A1 11/2009 Shields et al.
2009/0273422 A1 11/2009 Fullerton et al.
2009/0273424 A1 11/2009 Fullerton et al.
2009/0273440 A1 11/2009 Marschalek et al.
2009/0273553 A1 11/2009 Song et al.
2009/0273555 A1 11/2009 Song et al.
2009/0273557 A1 11/2009 Song et al.
2009/0273825 A1 11/2009 Ichikawa et al.
2009/0275170 A1 11/2009 Chen

* cited by examiner

LATCH FOR TILTABLE SASH WINDOWS

FIELD OF THE INVENTION

This invention relates to a tilt latch mechanism for use in a pivotable sash window, and more particularly to a latch bolt designed to efficiently withstand high wind loading while simplifying installation into a window.

BACKGROUND OF THE INVENTION

One of the most valuable and cherished possessions, for many people, is unquestionably his or her own home, which is reflected by the fact that home improvement beyond the traditional contractor renovation has become a major industry. These home improvements include upgrades in older homes in the form of upgraded electrical service, copper plumbing, and particularly replacement windows. A long-standing reason for window replacement, in addition to improved curb appeal, had been the dramatic improvements in thermal efficiency of the double-paned window arrangement, which had already been incorporated into most new construction.

However, windows to be utilized for either new construction or as replacements have seen further improvement as a result of advances in building technology. Improvements to fenestration products have in part been driven by the need to meet more demanding national standards, and in some locations, local building codes which are even more stringent.

A major factor in devising such strict requirements is the ability of the windows to resist damage caused by storms, where storm damage to homes is typically attributable to the storm surge, flood damage, and wind damage. Damage attributed to hurricane Katrina striking the New Orleans area is estimated to be $81.2 billion dollars, and although much of that amount had been due to the flooding which resulted from the levee breaks, shattered windows from hurricane force winds is a significant contributor. Katrina had reached category five in intensity on the Saffir-Simpson Hurricane Scale, but then dropped to category three intensity once it made landfall, and maintained sustained winds between 110-130 mph. Hurricane Andrew, which in 1992 actually struck the Miami-Dade part of Florida at category five, had been the most costly natural disaster in American history, at roughly $26 billion. Victims of hurricane Andrew reported trying to ride out the storm while listening to the category five winds in excess of 156 mph shatter windows, with the glass being dispersed everywhere.

There were similar reports when hurricane Hugo struck South Carolina in 1989, devastating parts of historic Charleston. While the problem may be more often faced by residents of the southern and gulf states, it is not limited to those geographic areas. The "Great September Gale of 1815" was a category three hurricane that struck Long Island, New York, and broke through the barrier beach to create the inlet that still isolates Long Beach. Also, the New York Hurricane of 1893 directly struck New York City, and the Great New England Hurricane in 1938 killed over 682 people and cause over $4.7 billion in damage (2005 U.S. dollars). On average, a hurricane will make landfall in New England every 10-20 years, with last such case being Hurricane Bob in 1991, which killed ten people and caused 2.8 billion dollars in damage (2005 U.S. dollars). Window damage caused by weather phenomena, although very costly and common because of coastal hurricanes, is also problematic for many parts of the country that experience similar risk of damage during tornado season.

However, many if not most coastal areas now mandate that the windows installed be constructed to be both impact resistant and to satisfy other standards. One such standard includes a requirement that the window be able to withstand, for a set period of time, a certain design pressure (DP). A window with a DP30 rating, which would permit the window to maintain its integrity throughout the sustained winds of a category three hurricane, is rated to a pressure level equivalent to 110 mph wind speed, but is tested structurally at a pressure equivalent to 164 mph. Similarly, a window with a DP40 rating is rated to a pressure level equivalent to a 127 mph wind speed, but is tested at a pressure equivalent to a wind speed of 190 mph, and a DP50 rating requires satisfaction of even higher load requirements. Under high wind loading, it is not uncommon to see a window convex a couple of inches, but when properly designed, the window will regain its original form within the window frame. But this deformation under high wind loads creates another design consideration relating to the hardware.

A typical latch for a slidable sash window is shown by U.S. Pat. No. 4,901,475 to Simpson. A latch bolt is spring-loaded relative to its housing, and capable of movement between a retracted or unlatched position, and an extended or latched position. Only a relatively short throw is needed to retract the latch bolt and permit movement of the sash window.

Similarly, another latch for a tilt window is shown by U.S. Pat. No. 7,171,784 to Eenigenberg. The Eenigenberg latch has the same characteristic short throw to retract the latch bolt within the housing, but additionally offers structure permitting its use as a right-hand or a left-hand latch bolt.

Although the short throw characteristic of these tilt-window latches is very desirable, in terms of convenience to the user, and is satisfactory as far as the utility required for personal security, it is deficient maintaining latch integrity during severe weather conditions. Under the high wind loads experienced during a hurricane, the associated deformation to the window may cause the latch bolt to twist and thus the flat face of the bolt will not remain fully engaged with the jam. Also, the deformation, due to the convexing of the window from the winds, may reduce the amount by which any portion of the latch bolt remains engaged with the jam.

A simple solution to the problem would of course be to use a longer latch bolt, and to design the arrangement to have a longer throw, or travel distance, between the engaged and disengaged positions. However, that approach dilutes the advantageous nature of a quick release latch, where any user is able to easily open the window or rotate the window for cleaning, which generally occurs with far greater frequency than that for which such improved hurricane resistance characteristics are normally needed. This invention discloses a tilt latch capable of maintaining its integrity during high wind loading, while maintaining the convenience and overall utility of a short-throw latch bolt.

SUMMARY OF THE INVENTION

The latch of this invention is designed to be able to resist the "twist-out" effect that occurs when a window undergoes substantial deformation, which may occur as a result of the high sustained winds found in a hurricane, as well as the winds that may be found around the periphery of a tornado. The latch features disclosed herein may be utilized on any number of different latch types, but they are particularly useful for the sash window of a tiltable double hung window assembly.

The latch of this invention features a latch bolt, which is biased relative to the sash window, and is capable of resisting twist out effect without requiring large-scale changes to the latch bolt, which would affect its size and ease of use, particularly with regard to the throw of the latch. The throw of the latch bolt is unaffected by incorporation of the features of this invention.

The latch of this invention comprises a couple of different features. In order to successfully counter twist-out effect without modifying the size of the latch bolt and its throw, the nature of engagement of the face of the latch bolt tongue with the window jam becomes critical. Improvements to that engagement may be accomplished herein through a number of different embodiments. In one embodiment, an angled groove passes across the face of the latch bolt tongue in a direction roughly in line with the direction of the jam. The groove may begin at either the upper or the lower edge of the tongue, or may also alternatively begin at some position in between the upper and lower edges of the tongue. The angled groove feature has a combined effect, the first of which involves the creating an angled face on the tongue face, where the angle of the face may be designed for a particular size window so as to become flush with the jam, when the window and latch are experiencing high wind loads and deformation leading to twisting of the latch. In addition, the angled groove also creates lateral faces which may catch upon the window jam flange to aid the latch in resisting disengagement from the jam.

This angled groove may also, in another embodiment, be utilized in two places on the latch tongue. The tongue may have one angled groove beginning at some mid-point on the latch tongue front face and running towards the upper edge with progressively increasing depth, while another angled groove begins just below the first angled groove and runs down towards the lower tongue edge with progressively increasing depth. This tongue configuration would permit the latch bolt to be utilized in either a left-hand or a right-hand installation.

Another possible embodiment would have a groove which is not angled but rather parallels the front face of the latch bolt tongue. This parallel groove, similar to the angled groove, could run from top to bottom, bottom to top, or may alternatively run in either direction while beginning at some intermediate point between the upper and lower edge of the tongue. Additionally, the tongue of the latch bolt could have two such parallel grooves where one runs towards the top edge of the tongue, and the other runs down to the bottom edge of the tongue, with both grooves beginning at some intermediate point between the upper and lower edge of the tongue.

It should be apparent to one skilled in the art that although such a latch may typically be used for a tiltable sash window which rotates downward and inward (see FIG. 1), it could also be used be used for a window that rotates clockwise and inwards or counterclockwise and inwards, in which case use of the terms up or down in describing the direction the groove runs on the tongue front face may presumably be replaced by left and right. The latch is not limited to a horizontal installation despite the fact that certain terminology herein suggests that such a situation is possible if not likely.

OBJECTS OF THE INVENTION

It is an object of this invention to provide a latch to be installed on the top rail of a sash window of a tiltable double hung window assembly.

It is a further object of this invention to provide a latch in which the latch bolt may be toggled from the latched to the unlatched position with a short throw.

It is another object of this invention to provide a latch that can maintain positive contact with a window jam during sustained winds of a hurricane.

It is another object of this invention to provide a latch that can maintain positive contact with a window jam during sustained winds associated with the periphery of a tornado.

It is another object of this invention to provide a latch that can maintain positive contact with a window jam during load conditions imposed by pressure testing to simulate hurricane force winds.

It is another object of this invention to provide a latch that can maintain positive contact with a window jam under conditions in which the window experiences severe deformation.

It is another object of this invention to provide a window latch that can resist latch "twist-out" effect during high wind loading.

DETAILED DESCRIPTION OF THE PREFERRED EMBODIMENT

The latch design features of the present invention may be incorporated for use into any one of the various different latch configurations of the prior art, as well as others which may be created. The advantageous nature of these design features, which may be incorporated in whole or in part, are best described in terms of one of the particular latch embodiments, which may be utilized in many different applications, but are particularly useful for a tiltable sash window of a double-hung sash window assembly.

Figure 1:
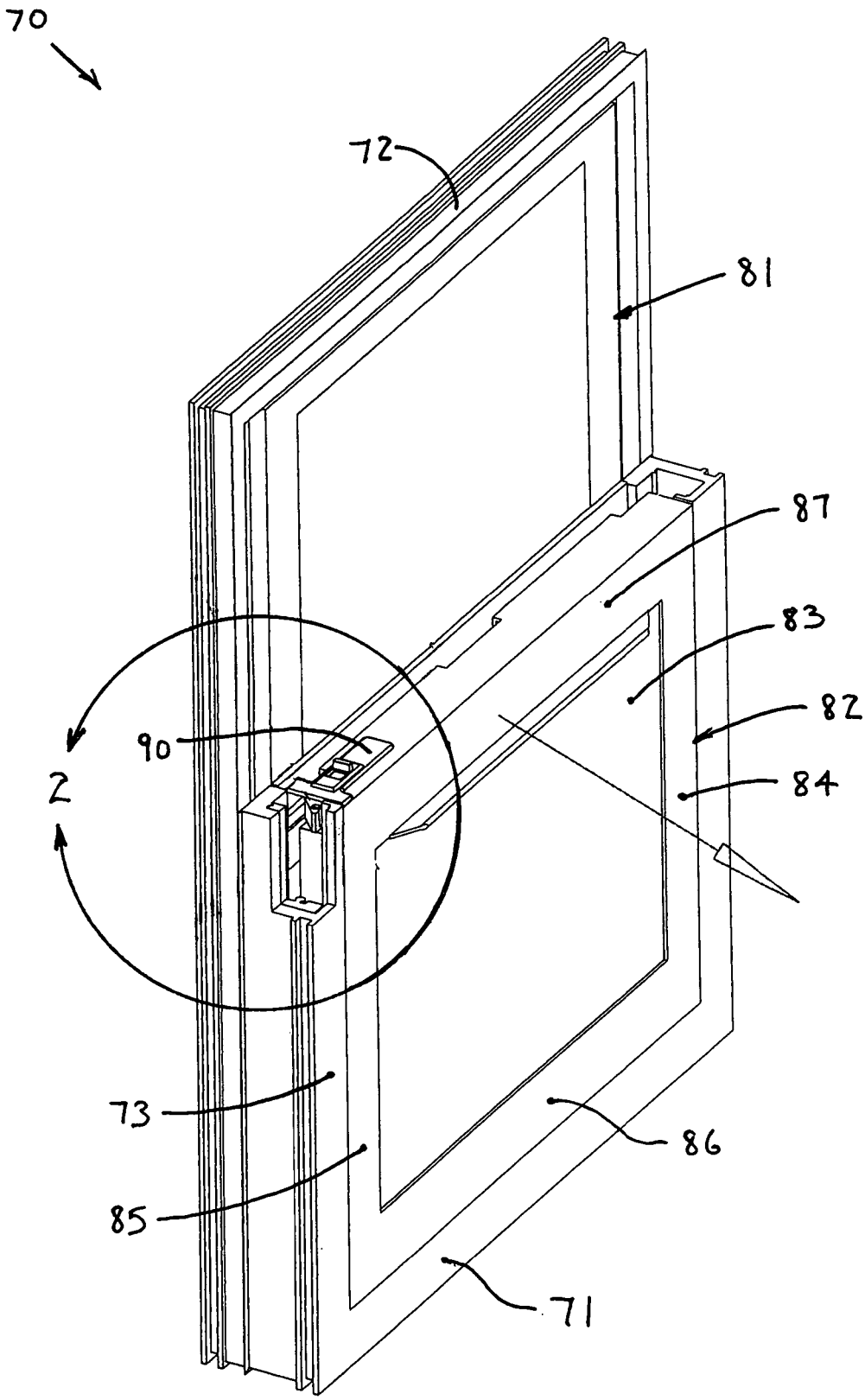
FIG. 1 is a perspective view of a tiltable sash window utilizing the latch of this invention, with part of the master window frame removed to reveal latch details.

FIG. 1 depicts a tiltable single-hung or double hung window assembly 70 with an upper sash window 81, lower sash window 82, and a master frame consisting of a sill portion 71, a head jam 72, and side jams 73. Portions of the head jam 72, and the side jams 78 have been cut away in the figure in order to illustrate the features of the jam with which the latch interacts. The lower sash window 82 is comprised of bottom rail 86, top rail 87, and stiles 84 and 85, which support the edge of the glazing, or glass pane 83. As is common for a tiltable double-hung sash window, the lower portion of the window has a connection to the frame (not shown) which is both pivotable and slidable with respect to the frame, and the upper portion of the window has a latch 90 with a tongue 91 which is also slidable with respect to the jam, but may also be retracted to permit the lower sash window 82 to rotate inward (see FIG. 2).

The tongue 91 of the latch 90 normally prevents the window from rotating inward, because, until the latch bolt is toggled, the front face 92 of the tongue 91 bears up against the bearing surface 75 of the side jam flange 74. It is this connection, as previously discussed, which is critical to withstand the high wind loads. When substantial deformation to the window occurs as a result of high wind loading, causing the latch bolt to twist, the flat front face 92 of the tongue 91 will not remain fully engaged with the jam. The twisting will tend to result in only one edge of the front face 92 making contact with the bearing surface 75 of jam flange 74, and additionally, the deformation due to the convexing of the window may further cause the tongue to be angled with respect to a vertical axis, such that only a portion of the bottom edge of the tongue maintains contact with the jam flange at the inner edge of the jam flange. These deformations make the latch subject to "twist-out" effect whereby the jam does not positively restrain the latch tongue, and the window may rotate under such loading.

A series of design modifications to the latch tongue found in this invention negate this effect, and are shown by the various exemplary embodiments of FIGS. 3-12. The advantageous nature of the design is illustrated by the latch embodiment 4 shown in FIG. 6, and also in FIG. 13 but at a larger scale. However, each of the latch embodiments shown in FIGS. 3-12 represent substantial improvements over a conventional latch in order to provide it with improved characteristics necessary to resist twist-out effect.

Figure 22:
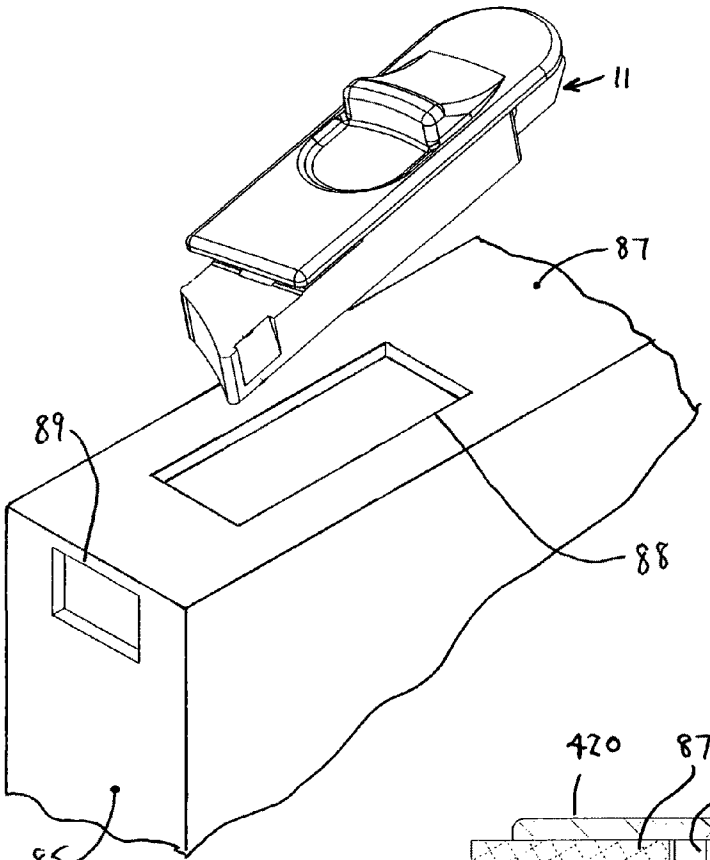
FIG. 22 is a perspective view of the $11^{th}$ embodiment of the latch and the sash window frame, before installation of the latch.
Figure 23:
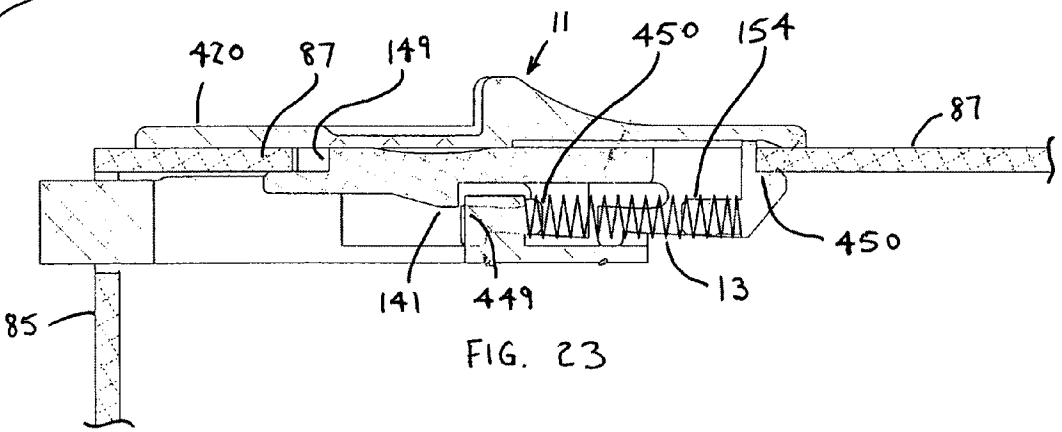
FIG. 23 is a section cut through the $11^{th}$ embodiment of the latch and sash window rail and stile, after installation of the latch.

The latch 4 embodiment (FIG. 13) comprises the latch body 420 which is a combination latch bolt and trigger, a spring 13 (FIG. 19) and fixed member 14. The fixed member 14 and latch body may be slidably interconnected (FIGS. 15-17, 21, and 23), whereby a portion of the fixed member extends beyond the latch body, and a portion of the latch body extends beyond the fixed member, and with other features co-acting, as will be described hereinafter. The fixed member 14 is set against the top rail 87 of the lower sash window 82, and in conjunction with spring 13, biases the latch body relative to the top rail 87 (FIG. 23). The combination of latch body 420, spring 13, and fixed member 14 may be installed through a pair of openings 88 and 89 (FIG. 22), which may be punched in the top rail and stile respectively. The size and position of the openings 88 and 89 may be coordinated to match the size of and spatial relationship between the tongue and latch bolt body.

The latch body 420 (FIG. 13) may comprise a top plate 421 which may sit flush atop the top rail 87. The top plate 421 may have rounded comers 422 for aesthetic appeal as well as for providing a safer end of the part as opposed to having a sharp edge. Protruding upward from the top plate is toggle button 424. Immediately adjacent to toggle button 424 is a recess 425 which permits the button to have a larger surface area that may be contacted by the thumb or fingers of the user seeking to pivot the window, while permitting a reduced height toggle button that protrudes at an unobtrusive height above the top rail 87. The top plate 421 may additionally have a raised area 423 if desired, as well as lateral extensions 426 and 427.

Figure 18:
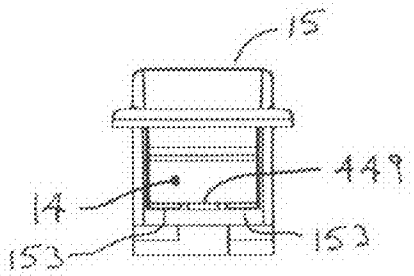
FIG. 18 is an end view of the $11^{th}$ embodiment of the latch according to the invention.
Figure 14:
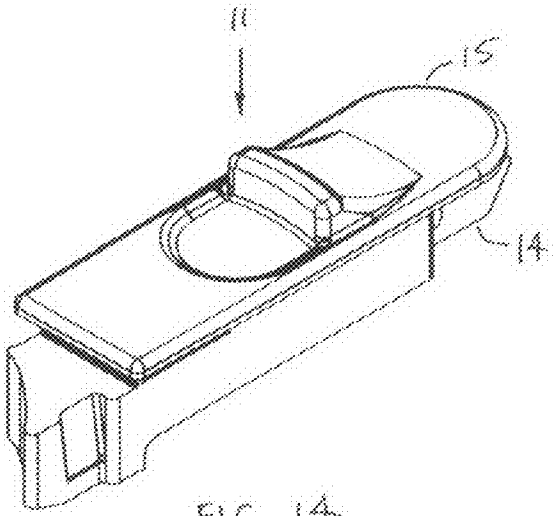
FIG. 14 is an enlarged perspective view of an $11^{th}$ embodiment of the latch according to the invention.
Figure 20:
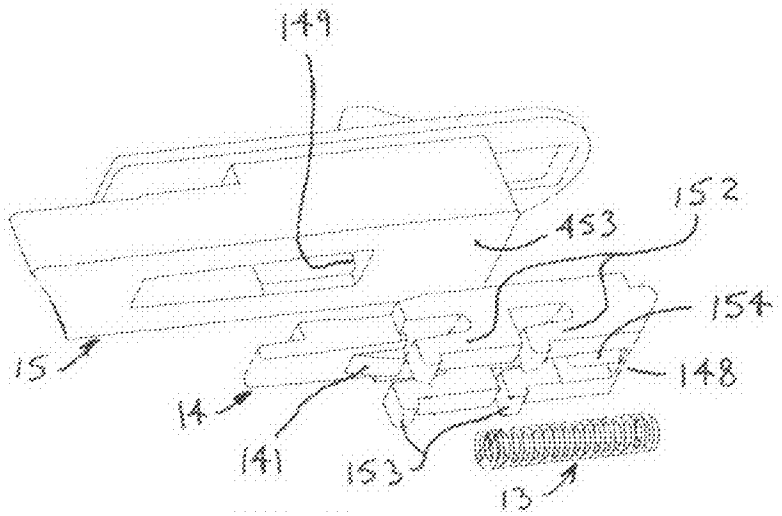
FIG. 20 is an exploded view of the reverse side of the parts comprising the $11^{th}$ embodiment according to the invention.
Figure 19:
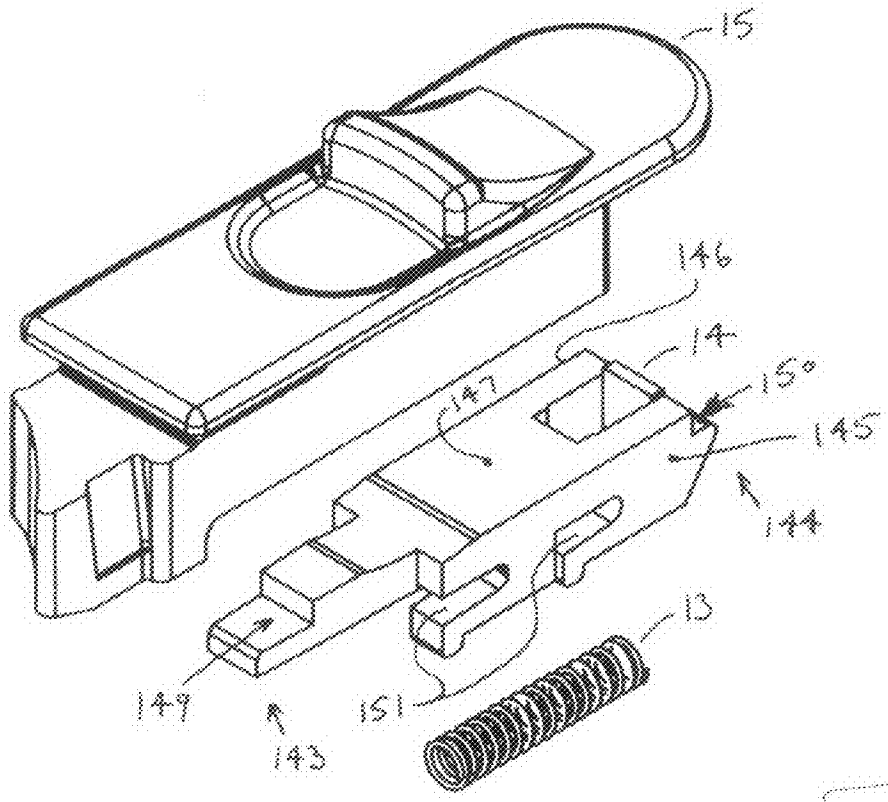
FIG. 19 is an exploded view of the parts comprising the $11^{th}$ embodiment according to the invention.
Figure 21:
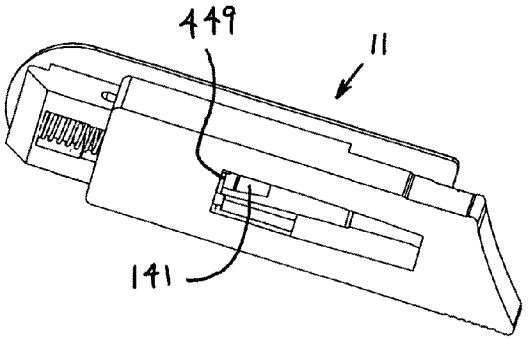
FIG. 21 is a bottom perspective view of the $11^{th}$ embodiment of the latch according to the invention, before installation.

The latch body 420 may further comprise a latch bolt housing 430 that may be either attached to or integral to the top plate 421. The housing 430 may have a first side wall 451, a second side wall 452, and a bottom wall 453, and the housing 430 has a first end 447 that may facilitate biasing of the latch bolt body relative to the window top rail 87, as will be seen later, and a second end 448 which terminates in latch bolt tongue 432. A portion of the fixed member 14 may be slidably retained by the walls of the housing (FIGS. 15-17, 21, and 23). The housing 430 may also have a plurality of protrusions 431 which may assist in retaining the latch bolt body within the top rail 87. The latch bolt housing may also have one or more protrusions to co-act with features on the fixed member, such as protrusion 149 that may co-act with a correspondingly located protrusion 141 on the fixed member (FIGS. 20 and 23) to limit biased travel of the latch bolt relative to the fixed member, and thus also limit its biased travel relative to the window stile. The protrusion 141, which may be located on the underside of the top connecting wall 147, may be sloped on one side and be flat on another side. The connecting wall 147 may span between first side wall 145 and second side wall 146 of the fixed member 14. At a first end 143 of the fixed member (FIG. 19), there may be a recess 149 in the top connecting wall 147, and another recess 150 at a second end 144 of the fixed member 14. There may also be an end wall 148 at the second end 144 of the fixed member 14, which may be angled (FIG. 20). The recess 150 may be formed in top connecting wall 147 at the second end of fixed member 14 or in the end wall 148. Also, as seen in FIG. 19, first side wall 145 and second side wall 146 may have a plurality of openings 151 so as to create a plurality of cantilevered members 152 (FIG. 20). The cantilevered members 152 may further comprise small protrusions 153 at the cantilevered end of the cantilevered members 152, which, as seen in FIG. 20, may make slidable contact with the underside of the housing bottom wall 453, once inserted therein (FIG. 18). To accommodate retention of the biasing spring 13, latch body 15 may have a post 450 (FIG. 23), and fixed member 14 may have a similar post 154.

Figure 15:
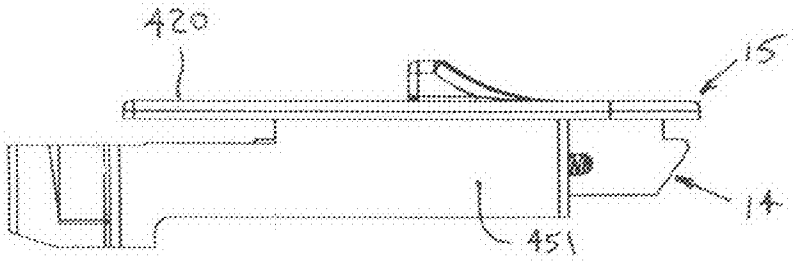
FIG. 15 is a side view of the first side of the $11^{th}$ embodiment of the latch according to the invention.
Figure 16:
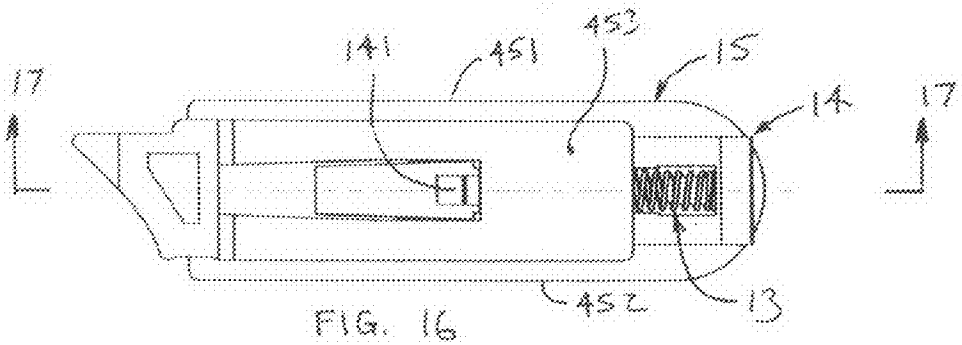
FIG. 16 is a bottom view of the $11^{th}$ embodiment of the latch according to the invention.
Figure 17:
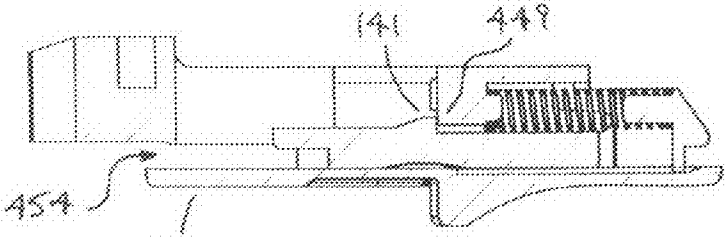
FIG. 17 is a side view of the second side of the $11^{th}$ embodiment of the latch according to the invention.

Latch bolt tongue 432 may be attached to or be integral to the housing 430 and top plate 420. Latch bolt tongue 432 may have a top surface 433 and bottom surface 434, which need not be, but is however shown as being generally parallel in the latch 4 embodiment, and the other embodiments. The top surface of the latch bolt tongue, as seen in FIGS. 15 and 17, may be formed so as to create a gap 454 with the top plate 420. This gap may be used to receive a first portion of the window top rail 87 for installation of the latch (FIG. 23), or alternatively, the recess 149 in fixed member 14, if the recess is of an appropriate depth, may work in conjunction with the top plate 420 to receive the portion of window top rail 87. The opposite end of the latch may retain a second portion of the top rail 87 using recess 150 and top plate 420. Furthermore, as to the latch bolt tongue 432, top surface 433 and bottom surface 434 need not be flat, and may conversely be curved in one or more directions. The latch bolt tongue 432 may also have a back face 435 that is slanted with respect to front bearing face 436, which extends between top surface 432 and bottom surface 433. The slanted face 435 and front bearing face 436 may form a sharp edge or may alternatively be formed so as to have a chamfered tip 37, or even a rounded tip. One end of the front face 436, as it meets the tip- either chamfered, rounded or a sharp edge- is its outer end 429, and is opposite the inner end 428. Outer end 429 and inner end 428 need not be parallel, and they need not form a linear edge.

Front bearing face 436, which will normally be flush against the bearing surface 75 of side jam flange 74, may be interrupted by a step feature, which, for embodiment 4 may comprise lower angled groove 438. Lower angled groove 438 may be created by the lower groove face 439 which is angled with respect to front bearing face 436 and thus would also form a first lateral face 440 and second lateral face 441. The groove face in this embodiment is flat, however, it could also be curved in this and any other embodiment. These lateral faces may similarly be flat, or they may be curved, or they may initially be flat and thereafter transition into a curved portion, essentially forming a fillet radius between a flat portion of the lateral face and the groove face. Also, these lateral faces 440 and 441 may be perpendicular to front bearing surface 436, or they may be angled with respect to front bearing surface 436 and may thus be so designed to catch a lip or recess formed at the junction of bearing surface 75 and side bearing surface 76 of side jam flange 74. The lateral faces may also be generally triangular in shape. In other embodiments described in subsequent paragraphs, when the groove face may have a different orientation with respect to the tongue front bearing face, these lateral faces may then be generally rectangular in shape, trapezoidal in shape, or possibly an irregular shape.

The step feature of the latch 4 embodiment may also comprise the front bearing face 436 being interrupted by an upper angled groove 442, which is similarly created by upper groove face 443, and first and second lateral groove faces 445 and 445, respectively. The front bearing face 436 being interrupted by lower angled groove 438 and upper angled groove 442 results in the front bearing surface 436 resembling an "H" shape, where the connecting portion or surface 446 would normally be in contact with the bearing surface 75 of side jam flange 74.

When the window 70, and consequently the latch 4, is subjected to the high wind load conditions, the design of the latch bolt tongue 432 enables the latch to resist the "twist-out" effect and remain positively engaged with the side jam flange 74 for a combination of reasons.

First, as the latch experiences twisting due to the wind loading, the connecting surface 446 that had been bearing upon bearing surface 75 of window 70, is now angled away from the bearing surface 75, but the angled groove face of the tongue 432 may now be flush to bearing surface 75. It can be appreciated by one skilled in the art, that the size and shape of a particular window will affect the magnitude of loading and twisting to the latch 4 installed in such a window, because the increased surface area of a larger window will produce higher loads under a 30, 40, or a 50 pound per square foot wind load condition, than a smaller window, and this load must be reacted by the latch 4. Therefore, the relative angle between the groove face 439 or 443, and the front bearing face of the tongue 436 (and more particularly connecting surface 446) may be increased or decreased for a particular window latch to accommodate such loading and twisting for a particular window design. In fact, that relative angle should necessarily be different and be custom designed for each particular window configuration.

Secondly, and perhaps more significant for the latch 4 to resist the high wind-loading, is the fact that lower angled groove 438 creates the lateral groove face 441, and similarly the upper angled groove 442 creates lateral groove face 445. When high sustained winds would create deformation that would tend to pull the tongue from the opening in the jam and permit the window to unexpectedly rotate, these lateral faces 441 and 445 may engage the side bearing surface 76 (see FIG. 2) of side jam flange 74 of window 70 to resist such loading.

Figure 2:
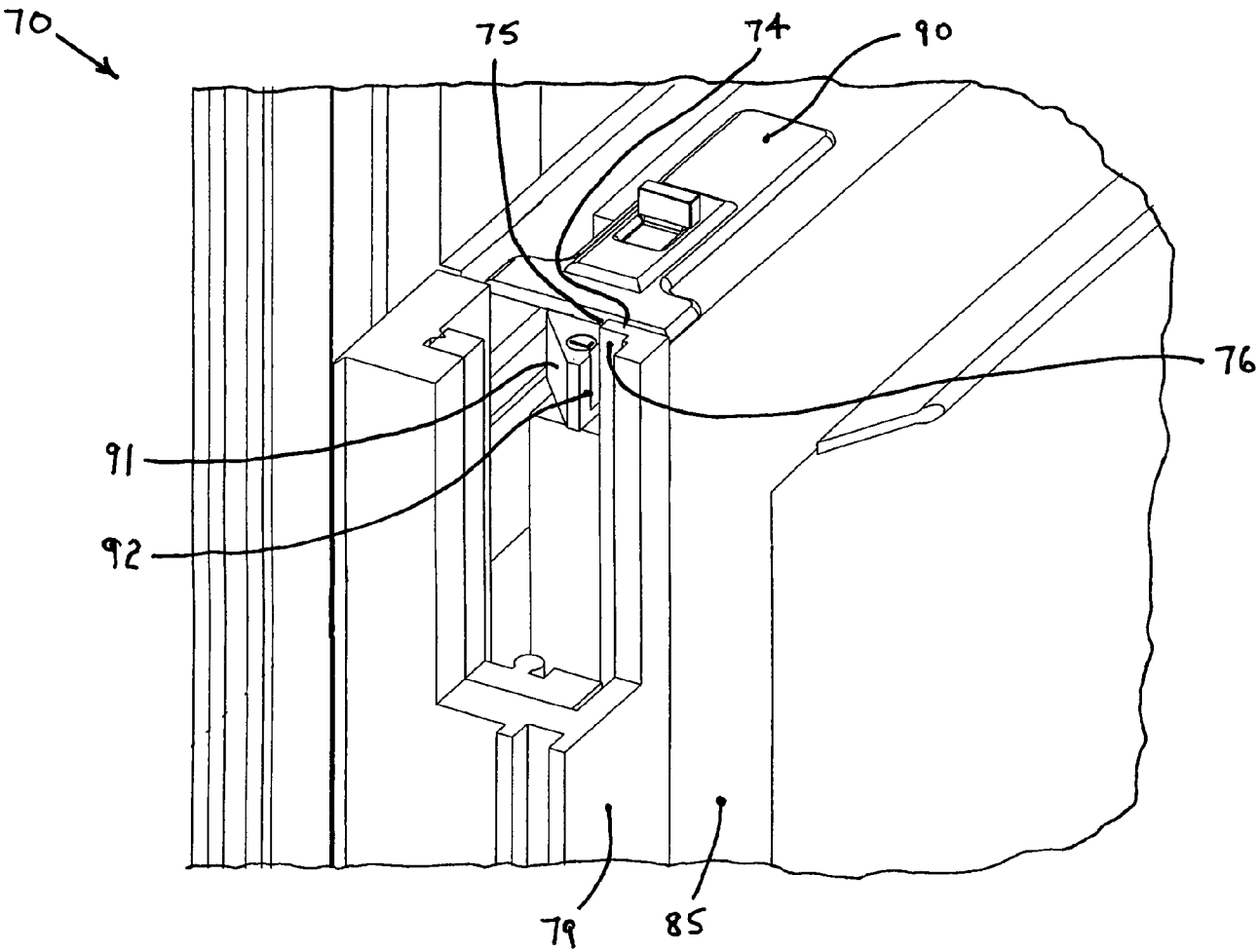
FIG. 2 is an enlarged perspective view of the latch details of FIG. 1.

While it would be apparent to one skilled in the art that loading of the window 70 will only produce twisting in one particular direction, so that having both the lower and upper angled grooves 438 and 443 on the latch 4 as installed in FIG. 2, would not be necessary, it is nonetheless beneficial. Having the tongue designed and manufactured as shown with both lower groove 438 and upper groove 443 allows the latch bolt to be utilized in either of the left-hand or the right-hand latch positions of the window 70.

Figures 3, 4, 5, 6, 7:
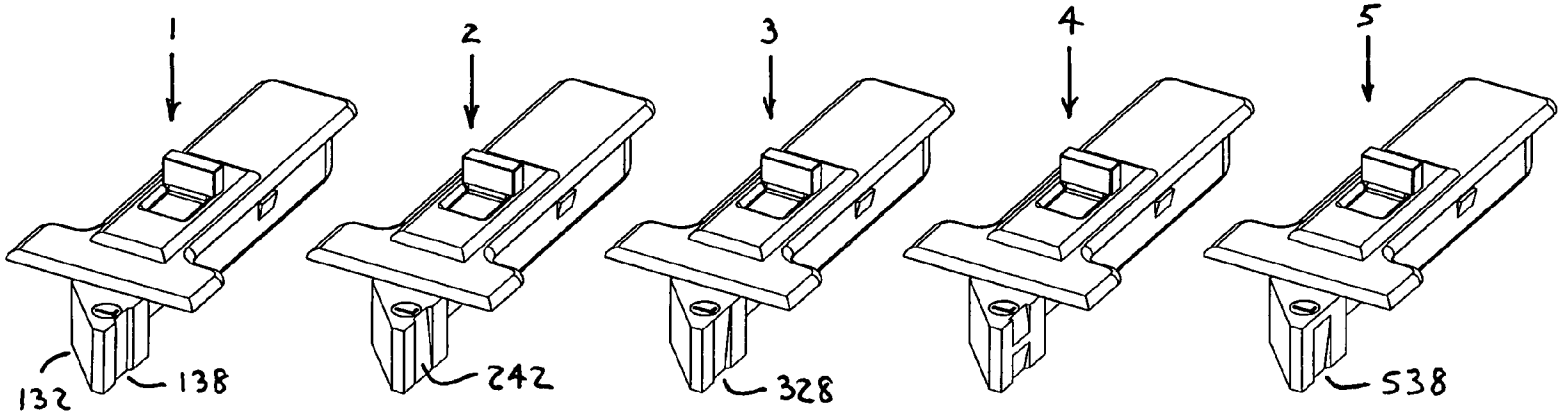
FIG. 3 is a perspective view of a $1^{st}$ embodiment of the latch of the current invention.
FIG. 4 is a perspective view of a $2^{nd}$ embodiment of the latch of the current invention.
FIG. 5 is a perspective view of a $3^{rd}$ embodiment of the latch of the current invention.
FIG. 6 is a perspective view of a $4^{th}$ embodiment of the latch of the current invention.
FIG. 7 is a perspective view of a $5^{th}$ embodiment of the latch of the current invention.
Figure 13:
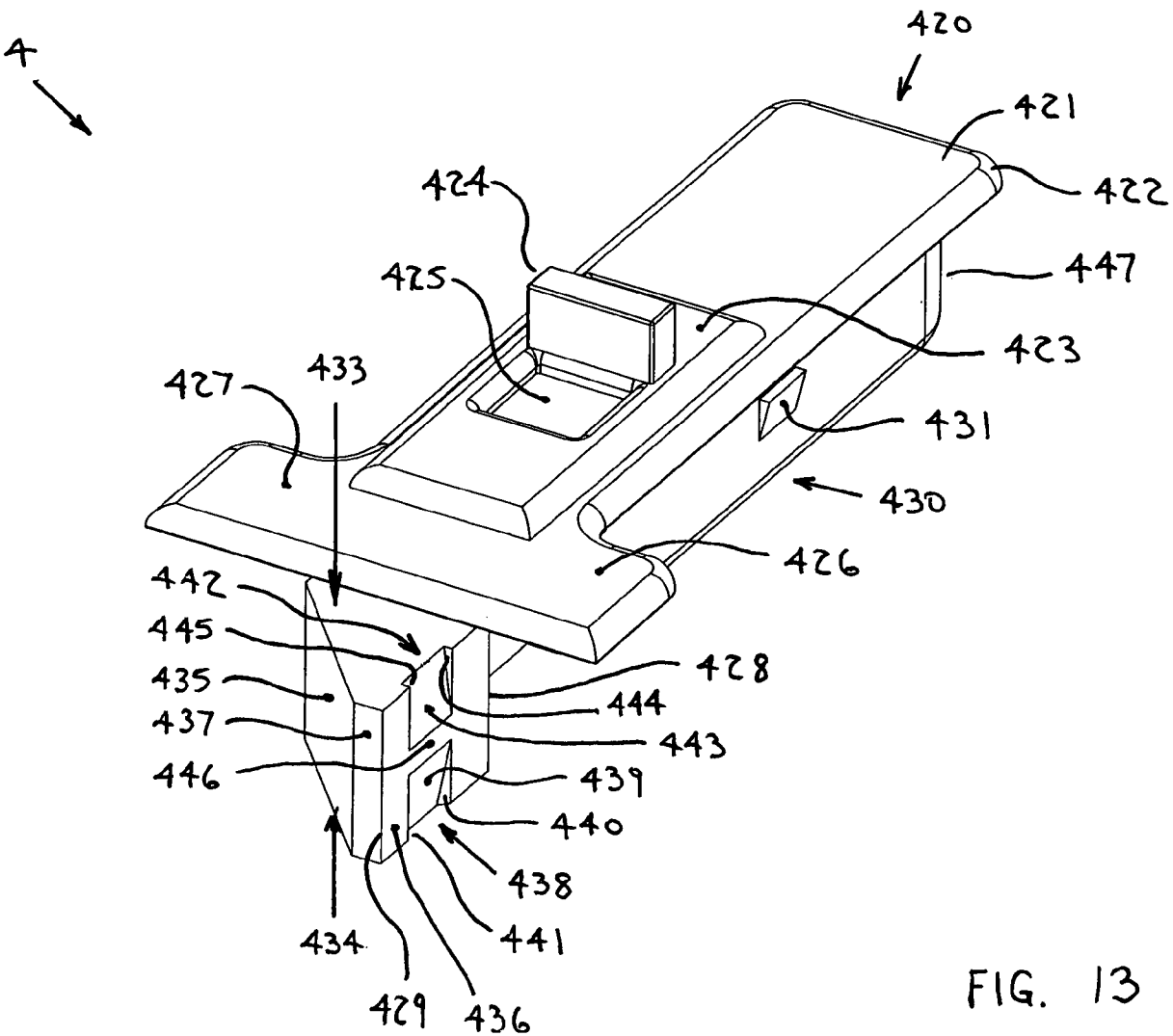
FIG. 13 is an enlarged perspective view of the $4^{th}$ embodiment of the latch according to the invention.

The advantageous nature of constructing the tongue 432 of a window latch 4 as shown in FIGS. 6 and 13, may also be recognized in the other possible embodiment as shown in FIGS. 3-5 and FIGS. 7-12. In the latch embodiment 1 of FIG. 3, the tongue 132 has a step feature in the form of a single groove 138, and unlike embodiment 4, the groove 138 is not angled with respect to the front bearing face of the tongue and actually parallels the front bearing face. Although this embodiment would not have an angled bearing surface to be flush with bearing surface 75 (see FIG. 2) of side jam flange 74 of window 70 as with embodiment 4, it would still be capable of meshing with the side bearing surface 76 to resist the tendency of the wind loading to pull the tongue from the opening.

Figures 8, 9, 10, 11, 12:
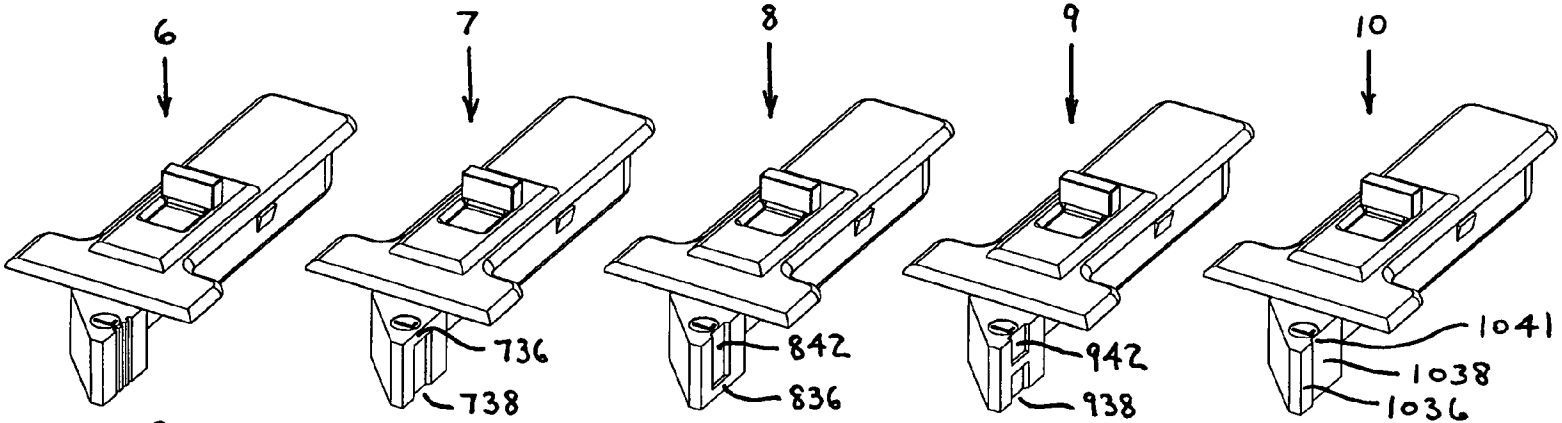
FIG. 8 is a perspective view of a $6^{th}$ embodiment of the latch of the current invention.
FIG. 9 is a perspective view of a $7^{th}$ embodiment of the latch of the current invention.
FIG. 10 is a perspective view of a $8^{th}$ embodiment of the latch of the current invention.
FIG. 11 is a perspective view of a $9^{th}$ embodiment of the latch of the current invention.
FIG. 12 is a perspective view of a $10^{th}$ embodiment of the latch of the current invention.

The embodiments 7 and 8, shown in FIGS. 9 and 10, may each have a parallel groove, 738 and 842 respectively, as with embodiment 1, but for embodiments 7 and 8 the parallel grooves 738 and 842 do not run vertically across the entire front bearing face, as there are connecting surfaces 736 and 836 respectively, which are comparable to connecting surface 436 of embodiment 4. Embodiment 9 incorporates a combination of both an upper and a lower groove, such that it may, like embodiment 4, be utilized in either of the left-hand or the right-hand latch positions of the window 70.

Embodiments 2 and 3 each have a single angled groove 242 and 328 respectively, and permit a similar response by the latch tongue to wind loading as with embodiment 4. However, embodiments 2 and 3 do not have a bearing surface, comparable to surface 446 of embodiment 4, which normally is flush to the bearing surface 75 of side jam flange 74 of window 70. The angled groove 242 of embodiment 2 begins at the tongue bottom surface, and can have some initial depth or may essentially have no depth or a zero depth where the groove begins at the bottom surface, but in either case the groove will have increasing depth with increasing distance from the bottom surface. Angled groove 328 may be similarly formed, but would actually begin at the tongue top surface and have increasing depth with increasing distance from the top surface.

Embodiment 5, shown in FIG. 7, is essentially configured like embodiment 4, except that it has only one angled groove 538, and thus would not be capable of installation in either the left-hand or right-hand latch positions as would be embodiment 4, nor would embodiments 2 and 3 have that left-hand right-hand installation advantage. However, utilizing only the single angled groove of embodiment 5 permits the groove to run across a greater vertical distance on the tongue for a given angle, which results in an increase in the depth of the lateral face which may engage the side bearing surface 76.

One additional embodiment that would be advantageous in resisting high sustained wind loading, is shown by embodiment 10 in FIG. 12. Embodiment 10 has a surface 1038 that is offset from and parallel to face 1036. Surface 1038 begins at the inner end of face 1036 so as to create a lateral face 1041, which may engage the side bearing surface 76 of side jam flange 74 of window 70, as already discussed.

Other modifications, substitutions, omissions and changes may be made in the design, size, materials used or proportions, operating conditions, assembly sequence, or arrangement or positioning of elements and members of the preferred embodiment without departing from the spirit of this invention as described in the following claims.

We claim:

1. A latch, for use in a frame of a tiltable single-hung or double-hung sash window to permit sliding of the sash by at least a tongue of said latch tracking against a side jamb of a master window frame, and to also permit releasable engagement of said tongue of said latch with the side jamb, where said engagement secures the sash against inadvertent sash tilting by said latch resisting twist-out effect when the window and latch experience high wind loading resulting in deformation, said latch comprising:

(a) a latch bolt; said latch bolt comprising:

a housing, said housing comprising a top plate, a bottom wall, and first and second side walls, said first and second sidewalls extending from at least a portion of a bottom surface of said top plate, said bottom wall connecting to at least a portion of said first and second side walls, said top plate, said bottom wall, and said first and second side walls forming a cavity, a first end of said housing having an opening into said cavity; and a tongue, said tongue extending from a second end of said housing and having a front bearing face extending between a top surface and a bottom surface, said front bearing face comprising a groove being oriented generally in a vertical direction with said groove comprising a groove face being angled with respect to said front bearing face, said groove further comprising first and second lateral faces extending between said groove face and said front bearing face of said tongue;

(b) a fixed member, said fixed member being slidably disposed within said cavity of said latch bolt housing, wherein at least a portion of said fixed member protrudes out from said first opening in said latch bolt housing; and (c) a spring, said spring biasing said latch bolt relative to said fixed member.

2. The latch according to claim 1 wherein a first end of said groove face intersects said front bearing face of said tongue at a location being in proximity to said top surface of said tongue, with a depth of said groove increasing in a downward direction; or wherein said first end of said groove face intersects said front bearing face of said tongue at a location being in proximity to said bottom surface of said tongue, with a depth of said groove increasing in an upward direction.

3. The latch according to claim 2 wherein said groove face is flat and said front bearing face is flat.

4. The latch according to claim 3 wherein an angle between said flat front bearing face and said flat groove face is set to resist deformation and twist-out effect based upon a size of the sash window and a design pressure level.

5. The latch according to claim 4 wherein said first and second lateral faces are each flat.

6. The latch according to claim 5 wherein said first and second lateral faces are each perpendicular to both said groove face and perpendicular to said front bearing face of said tongue.

7. The latch according to claim 6 wherein said groove further comprises a fillet radius between said flat groove face and each of said first and second flat lateral faces.

8. The latch according to claim 6 further comprising a button, said button protruding upward from said top plate of said housing.

9. The latch according to claim 8 wherein said button is integrally formed with said top plate.

10. The latch according to claim 1 wherein said spring comprises a helical compression spring.

11. A method for releasable securing one end of a tiltable sash window of a single-hung or double-hung window assembly to resist high wind loads associated with hurricanes and other extreme weather phenomena, said method comprising the steps of:

(a) providing a pair of latches capable of resisting twist-out effect occurring as a result of convexing due to window deformation from such wind loading, said pair of latches comprising first and second latches to engage respective opposing side jamb flanges of a master window frame, where said first and second latches comprise:

(1) a latch bolt; said latch bolt comprising:

a housing, said housing comprising a top plate, a bottom wall, and first and second side walls, said first and second sidewalls extending from at least a portion of a bottom surface of said top plate, said bottom wall connecting to at least a portion of said first and second side walls, said top plate, said bottom wall, and said first and second side walls forming a cavity, a first end of said housing having an opening into said cavity; and a tongue, said tongue extending from a second end of said housing and having a front bearing face extending between a top surface and a bottom surface, said front bearing face comprising a groove being oriented generally in a vertical direction with said groove comprising a groove face being angled with respect to said front bearing face, said groove further comprising first and second lateral faces extending between said groove face and said front bearing face of said tongue;

(2) an engagement member, said engagement member being slidably disposed in said cavity of said latch bolt housing, wherein at least a portion of said engagement member protrudes from said opening in said first end of said latch bolt housing; and (3) a spring, said spring biasing said engagement member outward from said housing;

(b) forming coordinated punched openings in the top rail and the stile on a first side of the frame of the sash window;

(c) forming coordinated punched openings in the top rail and the stile on a second side of the frame of the sash window;

(d) installing, on the first side of the sash window, said first twist-out resistant latch by:

(1) inserting said first latch, at an angle, into said coordinated punched opening in said top rail of said window, said tongue being inserted first and being inserted so as to thereafter have a portion of said tongue pass through and exit out from said coordinated punched opening in said stile;

(2) further inserting said latch, to position a gap between said top plate of said housing and a top surface of said tongue upon a thickness of a first end of said punched rail opening;

(3) applying pressure to oppose said bias between said housing and said engagement member to compress said spring and cause said engagement member to be disposed within said housing cavity;

(4) pivoting said latch until a bottom surface of said top plate is flush with a top surface of said stile;

(5) removing said pressure from said engagement member to position a recess in said engagement member upon said thickness of said punched rail opening at a second end thereof, said spring means thereby biasing said tongue out of said coordinated punched opening in said stile of said window;

and (e) installing on the second side of the sash window said second version of said twist-out resistant latch in a similar manner as said first latch.

12. A latch, for use in a tiltable sash window, said latch comprising:

a latch bolt, said latch bolt comprising:

a housing formed by a top plate and one or more walls extending from a bottom surface of said top plate to form a cavity, a first end of said housing having an opening into said cavity;

a tongue, said tongue extending laterally from a second end of said housing and having a front bearing face extending between a top surface and a bottom surface, said front bearing face comprising a groove being oriented generally in a vertical direction with said groove comprising a groove face being angled with respect to said front bearing face, said groove further comprising first and second lateral faces extending between said groove face and said front bearing face of said tongue;

a fixed member, said fixed member being slidably disposed within said cavity of said housing of said latch bolt, wherein at least a portion of said fixed member protrudes from said first opening in said latch bolt housing; and a spring, said spring biasing said latch bolt relative to said fixed member.

13. A latch according to claim 12 wherein a first end of said groove face intersects said front bearing face of said tongue at a location being in proximity to said top surface of said tongue, with a depth of said groove increasing in a downward direction; or wherein said first end of said groove face intersects said front bearing face of said tongue at a location being in proximity to said bottom surface of said tongue, with a depth of said groove increasing in an upward direction.

14. A latch according to claim 12 wherein said groove face is flat.

15. A latch according to claim 14 wherein said first and second lateral faces are each flat.

16. A latch according to claim 15 wherein said first and second lateral faces are each perpendicular to both said groove face and perpendicular to said front bearing face of said tongue.

17. A latch according to claim 12 wherein said groove further comprises fillet radius between said groove face and each of said first and second lateral faces.

18. A latch according to claim 12 further comprising a button, said button protruding upward from said top plate of said housing.

19. A latch according to claim 18 wherein said button is integrally formed with said top plate.

* * * * *